US008893776B2

(12) United States Patent
Lacusta et al.

(10) Patent No.: US 8,893,776 B2
(45) Date of Patent: Nov. 25, 2014

(54) DOWNHOLE PORTED SHIFTING SLEEVE

(75) Inventors: Gregg Lacusta, Lloydminster (CA); Peter Steven David Krawiec, Bonnyville, CA (US)

(73) Assignee: Oil Rebel Innovations Ltd., Calgary, Alberta (CA)

( * ) Notice: Subject to any disclaimer, the term of this patent is extended or adjusted under 35 U.S.C. 154(b) by 359 days.

(21) Appl. No.: 13/484,135

(22) Filed: May 30, 2012

(65) Prior Publication Data

US 2013/0319694 A1 Dec. 5, 2013

(51) Int. Cl.
*E21B 34/14* (2006.01)

(52) U.S. Cl.
USPC ..... 166/107; 166/332.1

(58) Field of Classification Search
CPC ..... E21B 34/14
USPC ..... 166/69, 107, 117, 106, 387, 334.1, 166/332.1, 369, 373, 242.6
See application file for complete search history.

(56) References Cited

U.S. PATENT DOCUMENTS

| | | | | | |
|---|---|---|---|---|---|
| 2,180,605 | A * | 11/1939 | Otis | ..... | 166/205 |
| 4,350,205 | A * | 9/1982 | Goldschild et al. | ..... | 166/375 |
| 4,440,221 | A * | 4/1984 | Taylor et al. | ..... | 166/106 |
| 4,440,231 | A * | 4/1984 | Martin | ..... | 166/373 |
| 4,776,401 | A * | 10/1988 | Dollison | ..... | 166/369 |
| 8,528,632 | B2 * | 9/2013 | Mack et al. | ..... | 166/106 |
| 2012/0292045 | A1 * | 11/2012 | Krawiec et al. | ..... | 166/377 |

* cited by examiner

*Primary Examiner* — Kenneth L Thompson
*Assistant Examiner* — Steven MacDonald
(74) *Attorney, Agent, or Firm* — Gowling Lafleur Henderson LLP; D. Doak Horne

(57) ABSTRACT

A pump assembly for recovering hydrocarbons from downhole wells. The pump assembly comprising a seating surface adapted to sealingly engage an interior surface of a first circumferential seal means situated within production tubing when said pump assembly is in a downhole operative position. A downhole ported sleeve is further provided and comprises a first port means and a second port means. The ported sleeve is adapted to move within a seal sub comprising a lower seal means and an upper seal means. The first port means is positioned between the lower seal means and the upper seal means when the pump assembly is removed from the well, thereby preventing pressurized fluids and/or gases from reaching surface. A method for sealing a well upon removal of a pump is further disclosed.

10 Claims, 16 Drawing Sheets

DOWNHOLE PORTED SHIFTING SLEEVE

FIELD OF THE INVENTION

The invention relates to downhole tools for use in pumping hydrocarbons to surface, and more specifically to a downhole pump apparatus having a downhole ported shifting sleeve. Normally, when a downhole pump is to be removed for servicing or replacement, the well must be "killed" (i.e. prevent the well from flowing). The downhole ported shifting sleeve allows the well to be temporarily sealed downhole to allow the removal of a downhole pump for servicing or replacement.

BACKGROUND OF THE INVENTION AND DESCRIPTION OF THE PRIOR ART

When extracting hydrocarbons from production wells drilled into hydrocarbon formations, it is a safety and regulatory requirement that pressurized fluids and/or gases coming from the drilled well (e.g. sour gases), be isolated from surface to thereby prevent their escape to atmosphere at the surface of the well.

Specifically, downhole pump assemblies typically possess seal rings, which when the pump is installed in the operative position, typically engage circumferential seals within the casing or tubing in which the downhole pump assembly was placed and positioned, thereby preventing pressurized fluids and/or gases from flowing to surface except through the pump and thereby through the production tubing.

However, any raising of the downhole pump for the purposes of repair or replacement, as taught in the prior art, necessarily disengages the sealing rings, thereby releasing the downhole pressurized fluids and/or gases to surface.

To avoid this undesirable situation and to avoid communication with surface when a downhole pump assembly is being replaced, the prior art teaches that a well be effectively "killed" prior to pump removal, typically by pumping viscous fluids downhole to temporarily seal the well prior to blowout preventer installation and the pump being removed.

The process of "killing" a well each time to service downhole components is costly and time-consuming. Additionally, in some instances, the "killing" process may be too effective where it becomes difficult, and sometimes impossible, to later "restore" the well by removing the viscous fluids. Therefore, a well that is temporarily killed may unintentionally be permanently killed or unable to be brought back on-stream as effectively as before.

In heavy oil formations, where the produced oil contains large amounts of abrasive sand, wear on the pumps is extensive. This results in the necessity to frequently replace the pumps. As described above, replacing the pumps results in the undesirable need in the prior art to "kill" the well so that pressurized fluids and/or gases deep in the formation are not otherwise allowed to flow directly to surface.

A real need exists for a specialized apparatus and method for removing worn or defective pumps which avoids the need to first "kill" the well, or alternatively is able to avoid the pollution which would otherwise result from the release of pressurized fluids and/or gases from within the formation to surface via the open well.

SUMMARY OF THE INVENTION

In order to provide certain advantages over the prior art, it is an object of the present invention to provide a downhole tubing apparatus or downhole pump apparatus, as well as a method for removing same from a well, which avoids having to otherwise "kill" the well when a downhole pump is desired to be removed from the well for repair or replacement in order to avoid downhole pressures in a hydrocarbon formation from being exposed to surface.

It is a further object of the present invention to allow for casing flow in a production well to be "shut in" without breaking wellhead containment when a downhole pump is desired to be removed from the well for repair or replacement.

It is a further object of the invention to provide a downhole tubing apparatus to save rig time by eliminating time which would otherwise be required to "kill" the well prior to removal of a downhole pump, and to otherwise restore the rig to operation when the downhole pump assembly is reinserted and the well is desired to then be restored and brought back "on-line".

It is yet a still-further object of the present invention to provide a downhole tubing apparatus which allows unseating of a rod insert pump or other pump regardless of downhole pressures or temperatures.

Accordingly, in one broad aspect of the present invention, the invention comprises a downhole apparatus for preventing at least one of fluids and gases within a hydrocarbon formation from having communication with surface, the downhole apparatus comprising:

production tubing comprising a first circumferential seal means;

a pump assembly having a lower end and comprising:

a pump; and a seating surface constructed and arranged to sealingly engage said first circumferential seal means;

a seal sub positionable proximate said lower end of said pump assembly and comprising a lower circumferential seal means and an upper circumferential seal means longitudinally spaced-apart from each other within said seal sub;

a ported sleeve longitudinally spaced apart from said seating surface on the pump assembly and releasably coupled to said lower end of said pump assembly, constructed and arranged to sealingly engage said upper circumferential seal means and said lower circumferential seal means and for linear movement within said seal sub from a producing position to a sealing position, the ported sleeve comprising:

a first port means proximate a lower end of said sleeve; and a second port means proximate an upper end of the sleeve; and a releasable latch means on said lower end of said pump assembly, constructed and arranged for releasably coupling said ported sleeve;

wherein said ported sleeve is moveable from said producing position in which said first port means is positioned below said lower circumferential seal means and said second port means is positioned above said upper circumferential seal means to said sealing position in which said first port means is positioned between said lower circumferential seal means and said upper circumferential seal means and said releasable latch means de-couples from said ported sleeve when said pump assembly is raised from said downhole operative position.

In a second broad aspect of the present invention a method for preventing at least one of downhole fluids and gasses in a hydrocarbon formation from reaching surface, the method comprising the steps of:

(a) providing first circumferential seal means along an elongate tubing means;

(b) providing a downhole pump assembly, having at an upper end thereof a seating surface;

(c) providing a seal sub proximate a lower end of said elongate tubing means and comprising a lower seal means and an upper seal means;

(d) providing a ported sleeve, releasably coupleable to a lower end of said downhole pump assembly, and dimensioned to sealingly engage said lower seal means and said upper seal means, the ported sleeve comprising a first port means proximate a lower end of the ported sleeve and positionable below said lower seal means and a second port means proximate an upper end of the ported sleeve and positionable above the upper seal means;

(e) providing latch means, situated on a lower end of said downhole pump assembly opposite said upper end thereof, adapted for releasably coupling said ported sleeve to said lower end of said downhole pump assembly;

(f) lowering said pump assembly into a downhole operative position within a well so as to permit said seating surface thereon to sealingly engage said first circumferential seal means and to position the ported sleeve with said first port means positioned below said lower seal means and said second port means positioned above said upper seal means;

(g) raising said downhole pump assembly thereby ceasing sealing engagement between said first circumferential seal means and said seating surface, and simultaneously causing said ported sleeve to be raised so that the first port means is positioned between said lower seal means and said upper seal means so as to prevent communication from a downhole side of said ported sleeve to an uphole side of said ported sleeve; and (h) uncoupling said latch means from said ported sleeve so as to permit said ported sleeve to thereby remain downhole when said downhole pump assembly is further raised and removed from said well.

BRIEF DESCRIPTION OF THE DRAWINGS

Further advantages and permutations and combinations of the invention will now appear from the above and from the following detailed description of the various particular embodiments of the invention taken together with the accompanying drawings, each of which are intended to be non-limiting, in which.

DETAILED DESCRIPTION OF PREFERRED EMBODIMENTS

Figure 1A:
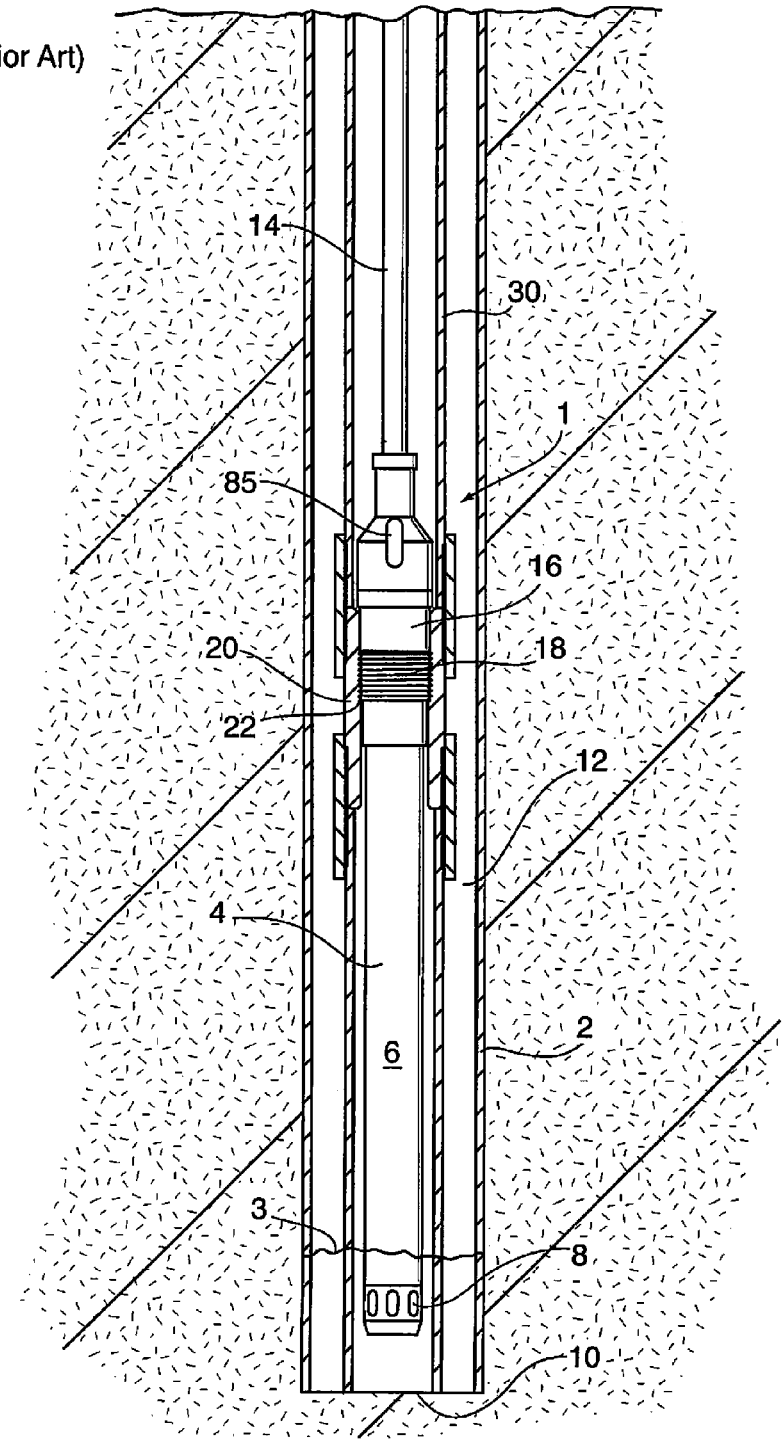
Fig.1A ( Prior Art)
FIG. 1A is a cross-sectional view of a prior art downhole tubing assembly in "top hold down" configuration and having a seating surface.

Referring to FIG. 1A, a downhole pump apparatus 1 of the prior art in a "top hold down" configuration is shown. The pump apparatus 1 is installed in a downhole operative (pumping) position in well casing 2 of a production well 12. The pump apparatus 1 is situated within production tubing 30 and comprises a pump assembly 4 having a pump 6 and a pump intake 8. The pump intake 8 may comprise a plurality of openings arranged around the circumference of the pump assembly 4 and/or comprise a single opening at the bottom of the pump assembly 4.

A production fluid (e.g. oil 3) being produced from the bottom 10 of well 12 enters pump intake 8 and is pumped upwardly within pump assembly 4 by pump 6 so as to be forced out exit aperture 85 within a top portion of pump assembly 4 and directly into production tubing 30 and thereby forced upwardly to surface.

In the downhole operative pumping position shown, pump assembly 4 is situated proximate the bottom 10 of well 12. A seating surface 18 on hold-down member 16 sealingly engages a circumferential seal 22 on seating nipple 20 situated within production tubing 30. This arrangement prevents the unregulated flow of pressurized fluids and/or gases otherwise than through the pump 6 and production tubing 30.

The configuration shown in FIG. 1A is commonly referred to in the art as a "top hold down" configuration, wherein the pump assembly 4 is situated below seating nipple 20 and thus the exterior of pump 6 is disadvantageously exposed to unregulated downhole reservoir pressures during pumping.

Pump 6 forming part of pump assembly 4 may comprise a rod pump and a polish rod 14 which reciprocates up and down and is provided to power pump 6. Alternatively, pump 6 may comprise electric submersible pumps or progressive cavity pumps, or any type of pump which may require removal for servicing and/or replacement.

Figure 1B:
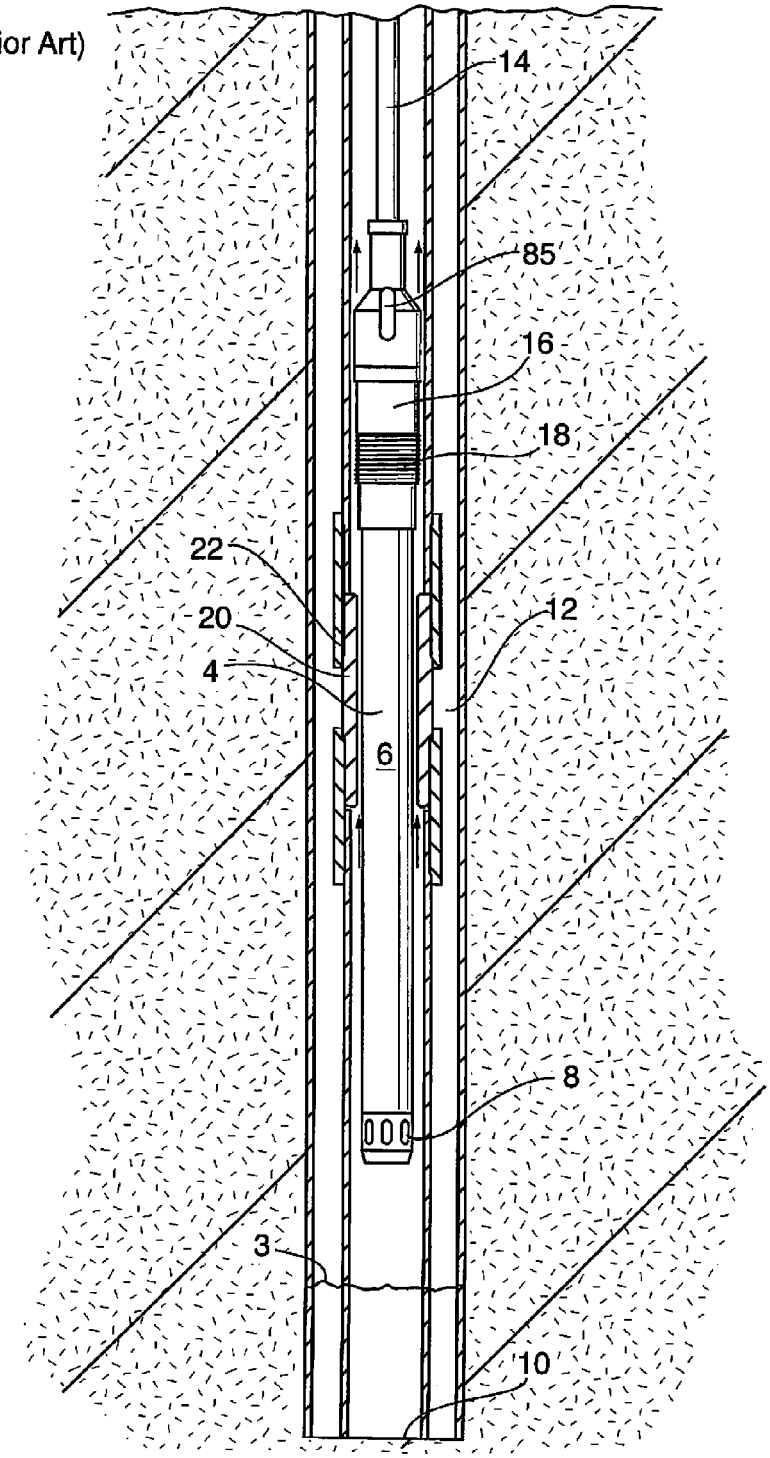
Fig.1B ( Prior Art)
FIG. 1B is a cross-sectional view of the prior art downhole tubing assembly of FIG. 1A, with the downhole pump assembly partially removed.

Referring to FIG. 1B, pump assembly 4 is being removed from the well 12 for the servicing or replacement of pump 6. Disadvantageously, as the pump assembly 4 is being raised from well 12, seating surface 18 on hold-down member 16 is raised and thereby removed from, and no longer sealingly engages, circumferential seal 22 on seating nipple 20. In such circumstances, downhole pressurized fluids and/or gases within the hydrocarbon formation may then flow uphole in an unregulated manner (as indicated by arrows) since the pressurized fluids and/or gases are no longer required to flow in a regulated manner through pump 6.

Figure 1C:
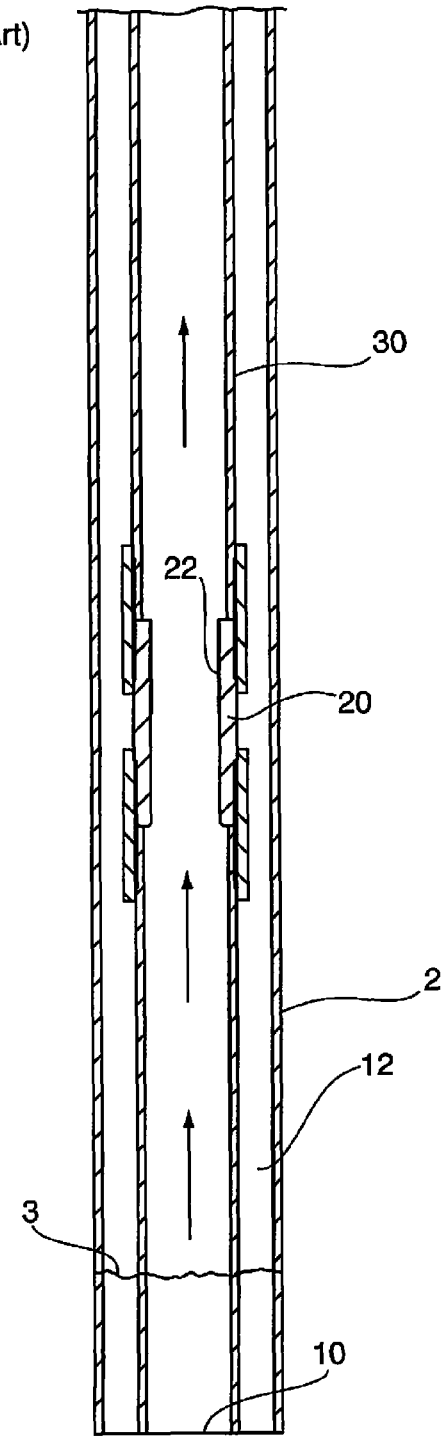
Fig.1C ( Prior Art)
FIG. 1C is a cross-sectional view of the downhole tubing assembly of the prior art, with the pump and seating surface thereof removed from the well.

Referring to FIG. 1C, the pump apparatus 4, including seating surface 18, has been completely removed from well 12, and downhole pressurized fluids and/or gases within the hydrocarbon formation are given free flow uphole in an unregulated manner (indicated by arrows). The downhole pressurized fluids and/or gasses will then be directly exposed to surface, via production tubing 30, unless the well has been previously "killed".

As seen in FIGS. 1A-1C, due to the "top hold down" configuration of pump assembly 1, the thin exterior of pump 6 is exposed to downhole reservoir pressures, which in high pressure reservoirs, can lead to pump 6 damage.

The present invention is adapted for use in association with any type of downhole pump 6 used in applications shown similar to that shown in FIGS. 1A-1C for pumping well bore fluids.

Particularly, the present downhole tubing assembly is adapted for uses such as that shown in FIGS. 1A-1C where a downhole pump 6 is required and in which the downhole pump 6 has to be removed from the well 12 for purposes of servicing or replacement.

Figure 3A:
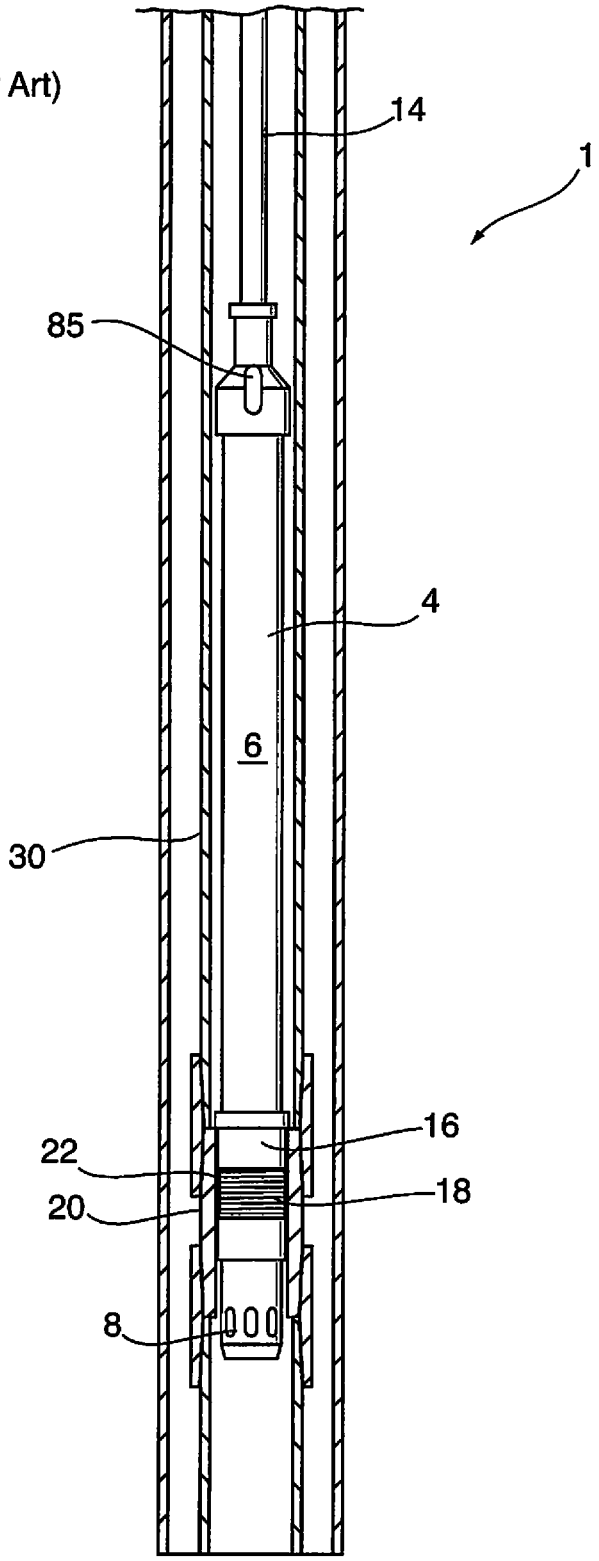
Fig.3A ( Prior Art)
FIG. 3A is a cross-sectional view of an alternative prior art downhole tubing assembly in "bottom hold down" configuration.

Referring to FIG. 3A, a modified pump apparatus 1, also used in the prior art, is shown in a "bottom hold down" configuration. In such a configuration, the downhole pump assembly 4 is positioned above seating surface 18 on hold-down member 16, thereby preventing, due to the sealing engagement of seating surface 18 with circumferential seal 22 on seating nipple 20, pressurized liquids and/or gases from within the reservoir from bypassing the pump 6 and thereby flowing to surface in an unregulated manner via production tubing 30. Since the pump assembly 4 is positioned above seating surface 18 on hold-down member 16, the pump 6 is positioned above the hold-down assembly so as not to be directly exposed to downhole reservoir pressure. Such a "bottom hold down" configuration is typically used in applications where there are concerns of excessive reservoir pressures which could possibly collapse the thin outer barrel of downhole pump 6.

Figure 3B:
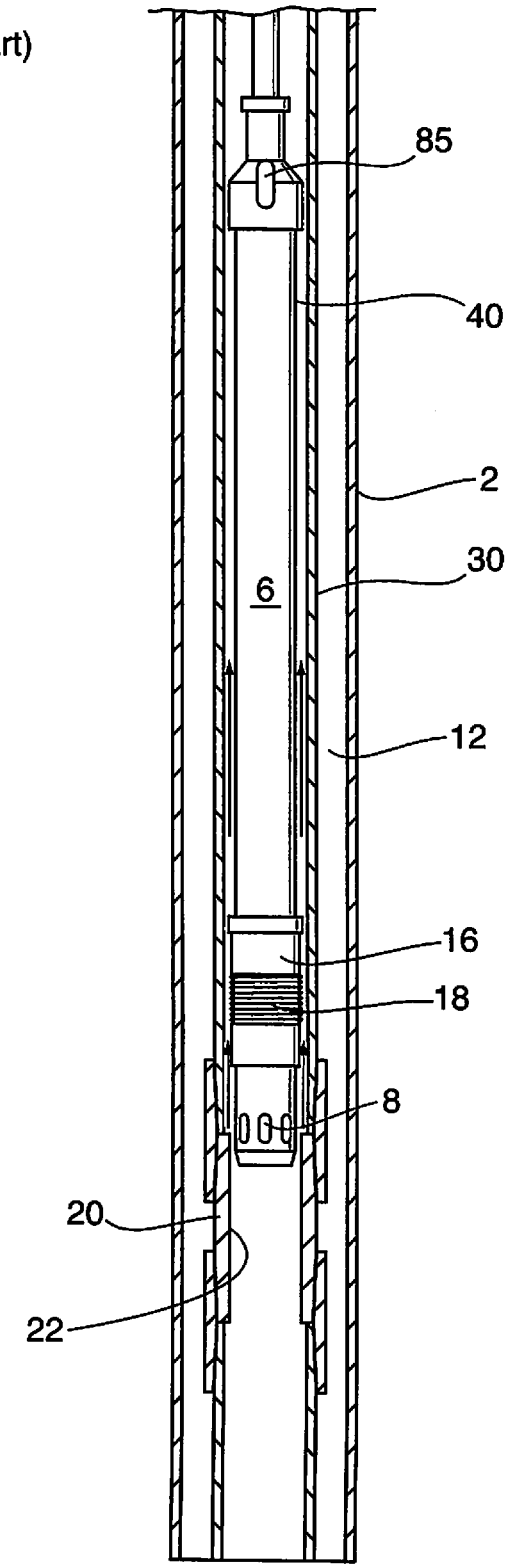
Fig.3B ( Prior Art)
FIG. 3B is a cross-sectional view of the prior art downhole tubing assembly of FIG. 3A, with such prior art downhole assembly partially removed from the well.

Referring to FIG. 3B, pump assembly 4 is being removed from the well 12 for servicing or replacement. Disadvantageously with regard to this configuration, as was the case with the prior art apparatus shown in FIGS. 1A-1C, as the pump assembly 4 is being raised from well 12, seating surface 18 on hold-down member 16 is raised from, and therefore no longer sealingly engages, circumferential seal 22 on seating nipple 20. The loss of sealing engagement of seating surface 18 with circumferential seal 22 on seating nipple 20 permits downhole pressurized fluids and/or gases to flow uphole in an unregulated manner (indicated by arrows).

Figure 3C:
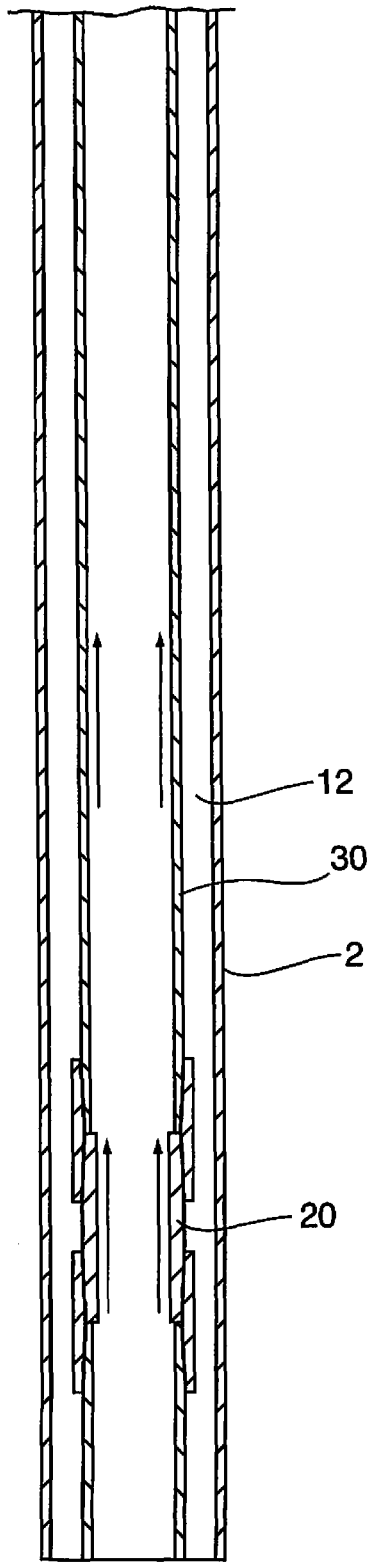
Fig.3C ( Prior Art)
FIG. 3C is a cross-sectional view of the downhole tubing assembly of the prior art shown in FIGS. 3A-3B, with the pump removed for servicing or replacement.

Referring to FIG. 3C, the pump apparatus 4, including seating surface 18, has been completely removed from the production well 12, and downhole fluids and/or gases within the hydrocarbon formation are given free flow uphole in an unregulated manner (indicated by arrows). The downhole pressurized fluids and/or gases will then be directly exposed to surface, via production tubing 30, unless the well has been previously "killed".

Figure 4A:
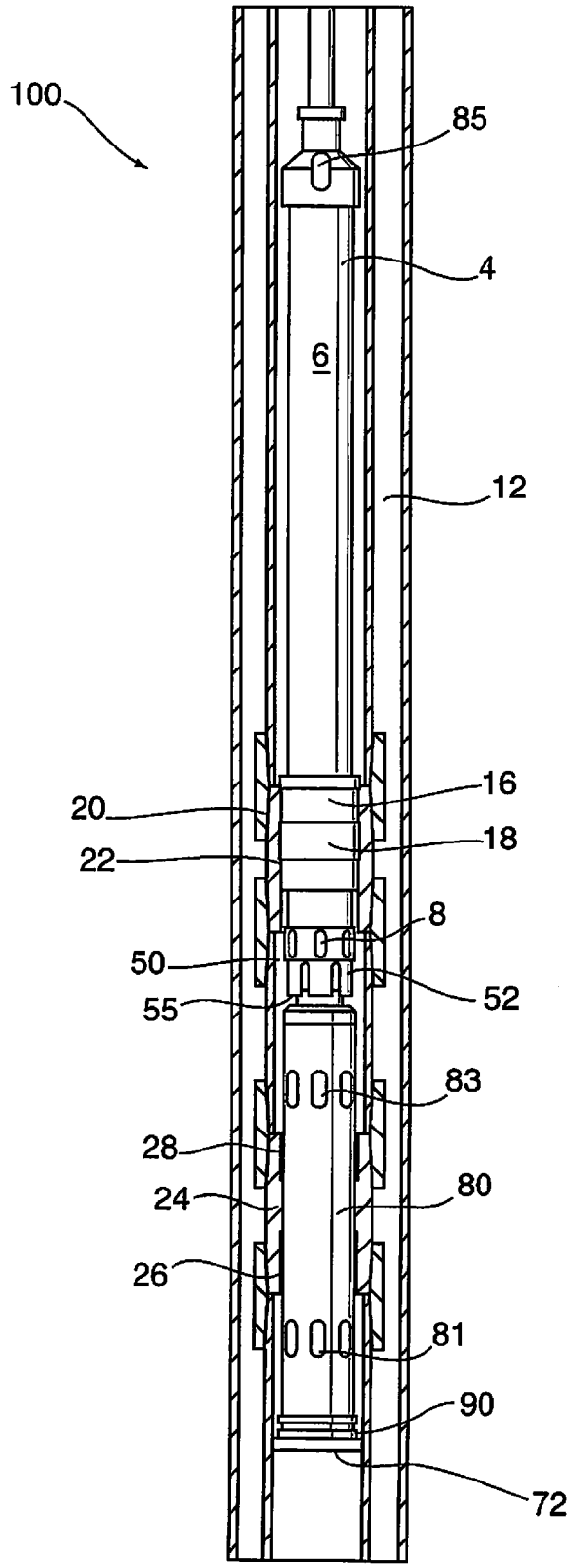
FIG. 4A is a cross-sectional view of an alternative embodiment of the downhole tubing assembly of the present invention having a seating surface.

Referring to FIG. 4A, a novel pump apparatus 100 is provided for preventing fluids and/or gases within a production well 12 from having communication to surface upon removal of the downhole pump apparatus 100 from the well 12. Pump apparatus 100 overcomes the disadvantages of the prior art designs and methods.

Pump apparatus 100 comprises a pump assembly 4 having a pump 6, in a "bottom hold down" configuration, where pump 6 is situated above a sealing surface 18 on a hold-down member 16. When pump apparatus 100 is in a downhole operative position, sealing surface 18 is adapted to sealing engage circumferential seal means 22 on seating nipple 20 which is threadably secured to production tubing 30.

The pump apparatus 100 further comprises a downhole ported shifting sleeve 80. The ported sleeve 80 is hollow and is releasably coupled (in the manner further explained below) to a lower end 45 of pump assembly 4, and dimensioned so as to sealingly engage seal sub 24, which contains a lower circumferential seal means 26 and an upper circumferential seal means 28. The lower circumferential seal means 26 and upper circumferential seal means 28 each comprise a single seal, or more preferably, a seal stack comprising multiple seals.

The ported sleeve 80 comprises first port means 81 proximate a lower end of the ported sleeve 80. The first port means 81 comprises at least one aperture in the ported sleeve 80 sidewall. Preferably, the first port means 81 comprises at least two apertures in the ported sleeve 80 sidewall. More preferably, the first port means 81 comprises a plurality of apertures in the ported sleeve 80 sidewall. The apertures may be machined into the sleeve 80 sidewall. The size, shape, and arrangement of the apertures can be varied, and would be in the knowledge of a person skilled in the art, in order to maximize the flow of production fluid through the first port means 81. For example, the apertures may have a uniform shape and size and be positioned equidistant from each other in the ported sleeve 80. Alternatively, the shape and size of each aperture may be different and the distance between each aperture may vary.

The ported sleeve 80 additionally comprises second port means 83 proximate an upper end of the ported sleeve 80. The second port means 83 comprises at least one aperture in the ported sleeve 80 sidewall. Preferably, the second port means 83 comprises at least two apertures in the ported sleeve 80 sidewall. More preferably, the second port means 83 comprises a plurality of apertures in the ported sleeve 80 sidewall. The apertures may be machined into the sleeve 80 sidewall. For example, the apertures may have a uniform shape and size and be positioned equidistant from each other in the ported sleeve 80. Alternatively, the shape and size of each aperture may be different and the distance between each aperture may vary.

The ported sleeve 80 further comprises a protruding lip 90 at its lower end, as described further below. In the downhole operative position, ported sleeve 80 is positioned in relation to seal sub 24 so that in a producing position, first port means 81 is located below lower seal means 26 and second port means 83 is positioned above upper seal means 28.

When pump 6 is activated, a production fluid (e.g. oil 3) is drawn from the well 12 through the first port means 81 and into ported sleeve 80, through the interior of the ported sleeve 80, and out of the ported sleeve 80 through second port means 83. In addition to oil 3, other downhole fluids (e.g. including mud) may be drawn from the well 12. The production fluid then enters production tubing 30 into the pump intake 8, and through pump 6 and out exit aperture 85 to surface. The sealing engagement between ported sleeve 80 and lower seal means 26 and upper seal means 28 of seal sub 24 prevents downhole pressurized fluids and/or gases from reaching surface in an unregulated manner.

The lower end 45 of pump assembly 4 comprises a releasable latch member 50, which is adapted for releasably coupling and de-coupling ported sleeve 80 from lower end 45 of pump assembly 4. Latch member 50 may comprise and operate similar to various "on/off" tools used in the industry, wherein in one particular "on/off" tool configuration is a protruding nub, which is releasably insertable into a helical slot milled into an exterior surface of the latch member 50 which forms part of a "J" slot. By lowering latch member 50 onto a component to which it is desired to become releasably coupled (in this case ported sleeve 80), much like the rotary motion imparted to a child's toy top when a downward motion is imparted, engagement of a protruding lug with a milled helical groove which is part of a milled "j" slot on respectively latch member 50 and coupled component (ported sleeve 80), when downward force is applied, causes relative rotation of each component relative to the other and thus movement of the lug within the "j" slot portion of the milled "j" slot to thereby couple latch member 50 to coupled component (ported sleeve 80). To release latch member 50 from releasable securement to ported sleeve 80 after the pump assembly 4 and ported sleeve 80 have been raised so that the first port means 81 is located within seal sub 24 and positioned between lower seal means 26 and upper seal means 28, a well operator momentarily reverses the direction of movement of the pump assembly 4 from up to down, thereby again forcing latch member 50 downwardly against the then-immobile ported sleeve 80, and this time due to the action of lug within helical grooves a reverse direction of rotation of the latch member 50 relative to the ported sleeve 80 is imparted, thereby removing the lug from within the "J" slot and permitting disengagement of the ported sleeve 80 from latch member 50, to thereby decouple latch member 50 from ported sleeve 80.

In a preferred embodiment, however, latch member 50 of the present invention comprises a plurality of resiliently flexible, hooked "fingers" 52, adapted to releasably encircle and grasp a protruding bulbous spherical knob 60 (shown in FIGS. 4C and 4D) on the ported sleeve 80 which extends upwardly therefrom. Each finger 52 comprises a hook edge 55 to strengthen the connection between the latch member 50 and protruding bulbous knob 60, which in a preferred embodiment may be frusto-conical in shape as shown in FIGS. 4C, 4D, 5 & 6, but other geometrical shapes, such as being hemispherical in shape provided a lip edge is provided to engage hook edge 55, would also be satisfactory.

Figure 4B:
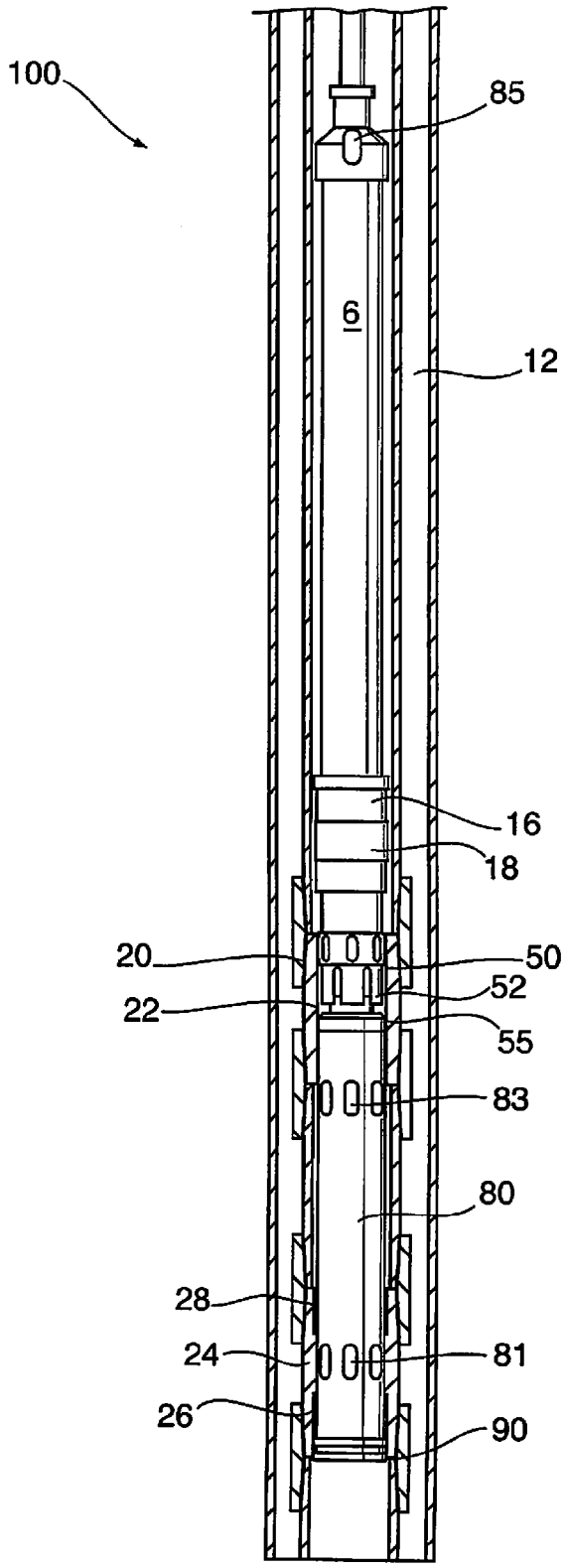
FIG. 4B is a cross-sectional view of the downhole tubing assembly of FIG. 4A, showing the pump assembly in the process of being raised to surface.

Referring to FIG. 4B, when pump 6 is desired to be serviced or replaced, pump assembly 4 is raised from the operative/producing position shown in FIG. 4A to a sealing position wherein advantageously the first port means 81 is positioned within seal sub 24 between lower seal means 26 and upper seal means 28, thereby preventing the flow of production fluid into ported sleeve 80. Due to the sealing engagement between ported sleeve 80 and seal sub 24, pressurized fluids and/or gases are also prevented from traveling uphole in an unregulated manner.

Figure 4C:
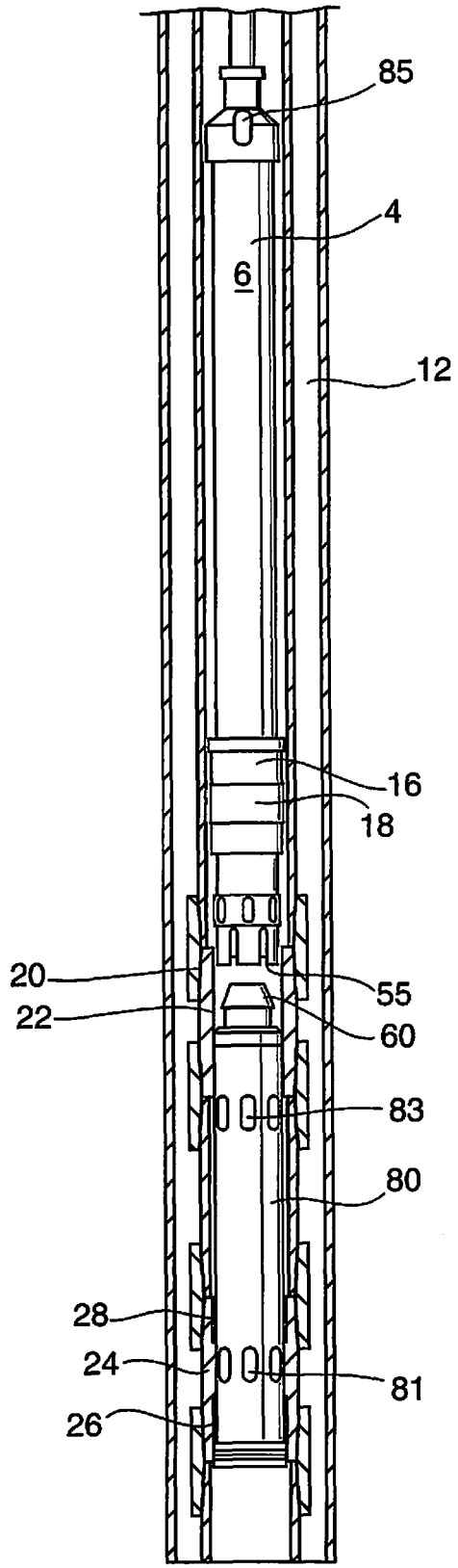
FIG. 4C is a subsequent cross-sectional view of the downhole tubing assembly of FIG. 4B, wherein the pump assembly has been further raised.

During the raising of pump assembly 4, latch member 50 (already physically coupled to ported sleeve 80 as shown in FIG. 4A) is also raised upwardly within production tubing 30. The contact of protruding lip 90 on ported sleeve 80 with seal sub 24 essentially creates a "no-go" situation preventing further upward movement of ported sleeve 80 and further resulting in the spreading or flexation of fingers 52 on latch member 50. The spreading or flexation of fingers 52 results in bulbous knob 60 on ported sleeve 80 being released from engagement with fingers 52 and hook edges 55, thereby decoupling ported sleeve 80 from engagement with latch member 50, as shown in FIG. 4C.

Figure 4D:
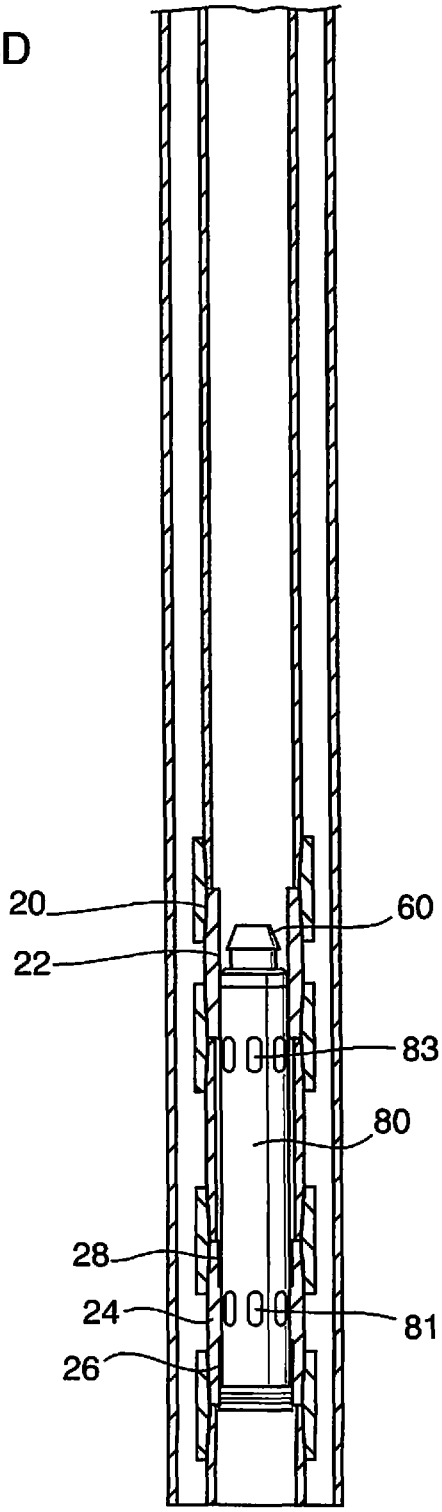
FIG. 4D is a subsequent cross-sectional view of the downhole tubing assembly of FIG. 4A-2C, wherein the pump assembly has been removed from the well.

Referring to FIG. 4D, pump assembly 4 has been raised to surface and removed from production tubing 30 so that pump 6 can be serviced or replaced. The positioning of ported sleeve 80, including first port means 81, within seal sub 24 between lower seal means 26 and upper seal means 28 prevents the passage of downhole pressurized fluid and/or gases from flowing to surface.

Advantageously, when a new or re-serviced pump 6 and pump assembly 4 is desired to be re-inserted downhole, the latch member 50 at the lower end of pump assembly 4 may be lowered in production tubing 30 and lowered onto bulbous spherical knob 60 on ported sleeve 80, in a reversal of the procedure shown in FIGS. 4A-4D, namely the procedure of FIGS. 4D-4A. While typically the frictional engagement between the ported sleeve 80 and the lower seal means 26 and upper seal means 28 of seal sub 24 will assist in allowing the latch member 50 to be re-coupled to ported sleeve 80, a "stop" bar 72 (as shown in FIG. 4A) may be provided, positioned in production tubing 30 of well 12, against which the ported sleeve 80 comes to rest against to definitively allow latch member 50 to be pressed onto (and fingers 52 thereon flex sufficiently to allow hook edges 55 thereof to hook and become releasably coupled to) bulbous knob 60 on ported sleeve 80 so as to allow latch member 50 to be again releasably coupled to ported sleeve 80.

Referring to FIGS. 2A-2D, an alternative embodiment of the pump apparatus 100 of the present invention is shown in which the pump assembly 4 and pump 6 are arranged in a "top hold down" configuration and wherein the seating nipple 20 and circumferential seal means 22 are therefore significantly spaced apart from sealing sub 24.

Figure 2A:
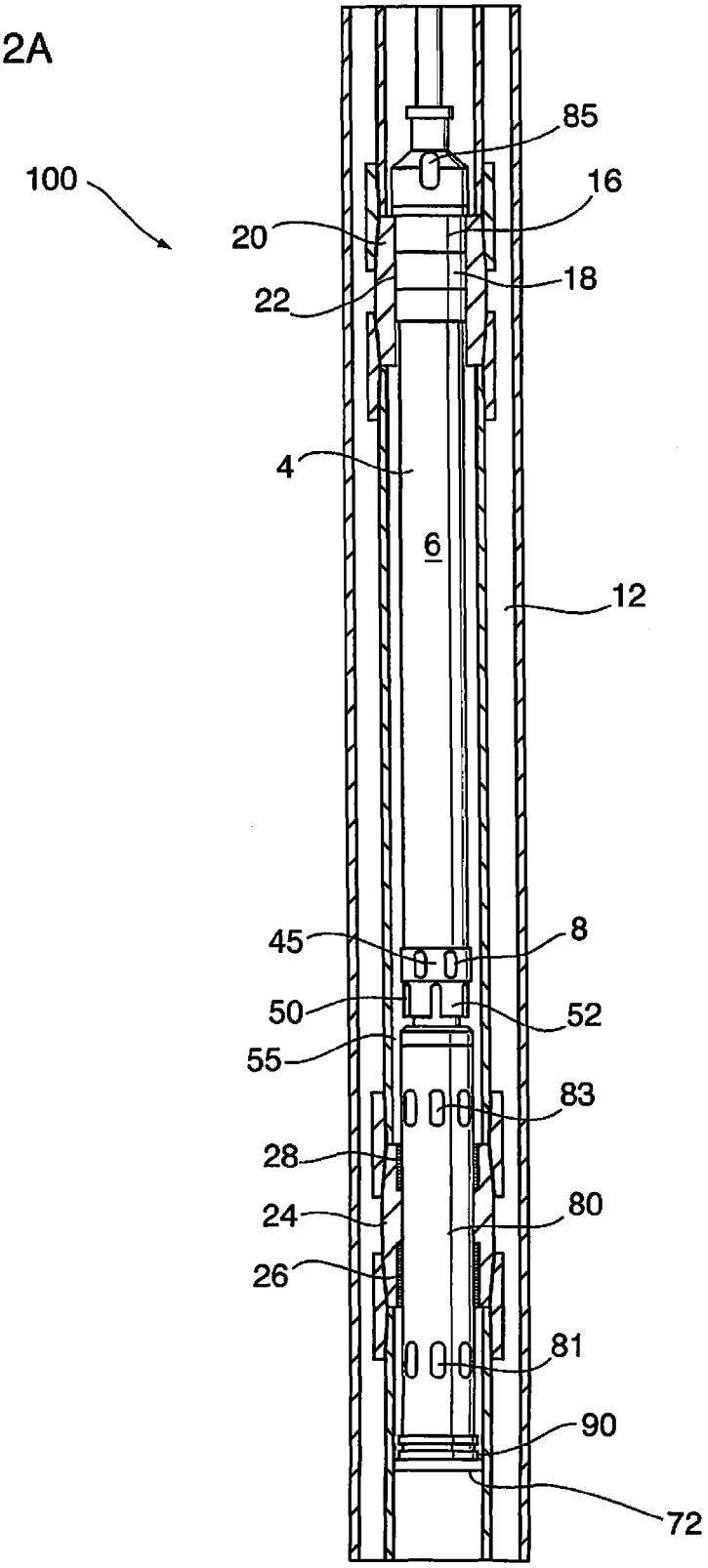
FIG. 2A is a cross-sectional view of an embodiment of a downhole tubing assembly of the present invention having a seating surface.

Referring to FIG. 2A, forming part of pump assembly 4 is a hold-down member 16, having a seating surface 18 thereon. Seating surface 18 is adapted to sealingly engage circumferential seal 22 on sealing nipple 20 when pump apparatus 100 is in operative pumping position.

Ported sleeve 80 is releasably coupled to a lower end 45 of pump assembly 4 and is sealingly engaged with lower seal means 26 and upper seal means 28 of seal sub 24. In a downhole operative/production position, first port means 81 is positioned within seal sub 24 between lower seal means 26 and upper seal means 28.

Latch member 50 is provided as described above, to allow ported sleeve 80 to be releasably coupled thereto and thus releasably coupled to pump assembly 4.

Figure 2B:
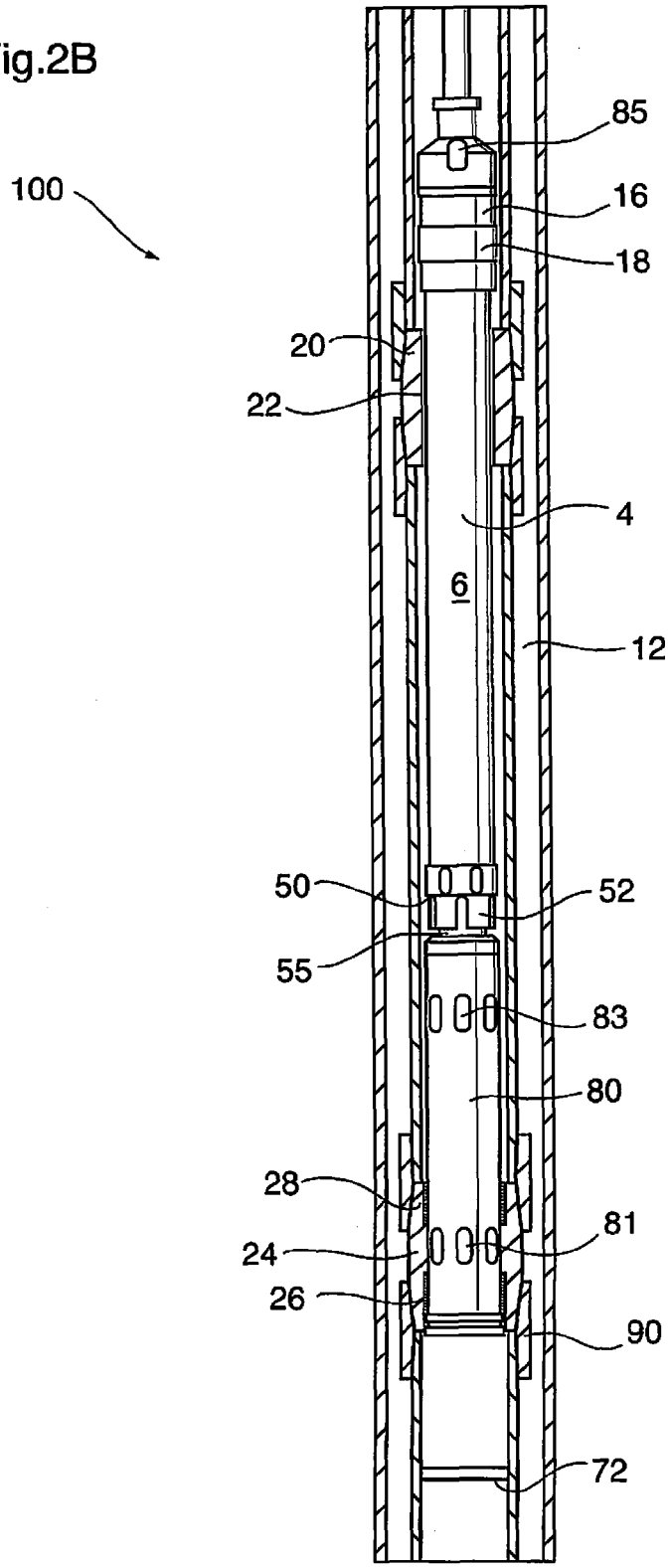
FIG. 2B is a cross-sectional view of the downhole tubing assembly of FIG. 2A, showing the pump assembly in the process of being raised to surface.

The method for removing the pump apparatus of FIG. 2A-2D from well 12 and from the operative pumping position as shown in FIG. 2A comprises the steps of firstly raising the pump assembly 4 to a position shown in FIG. 2B, thereby causing the seating surface 18 to cease sealing engagement with seating nipple 20, but simultaneously shifting ported sleeve 80 upwards so that first port means 81 is positioned within seal sub 24 between lower seal means 26 and upper seal means 28, thereby preventing fluid from a downhole side of ported sleeve 80 from being able to pass to an uphole side of ported sleeve 80.

Figure 2C:
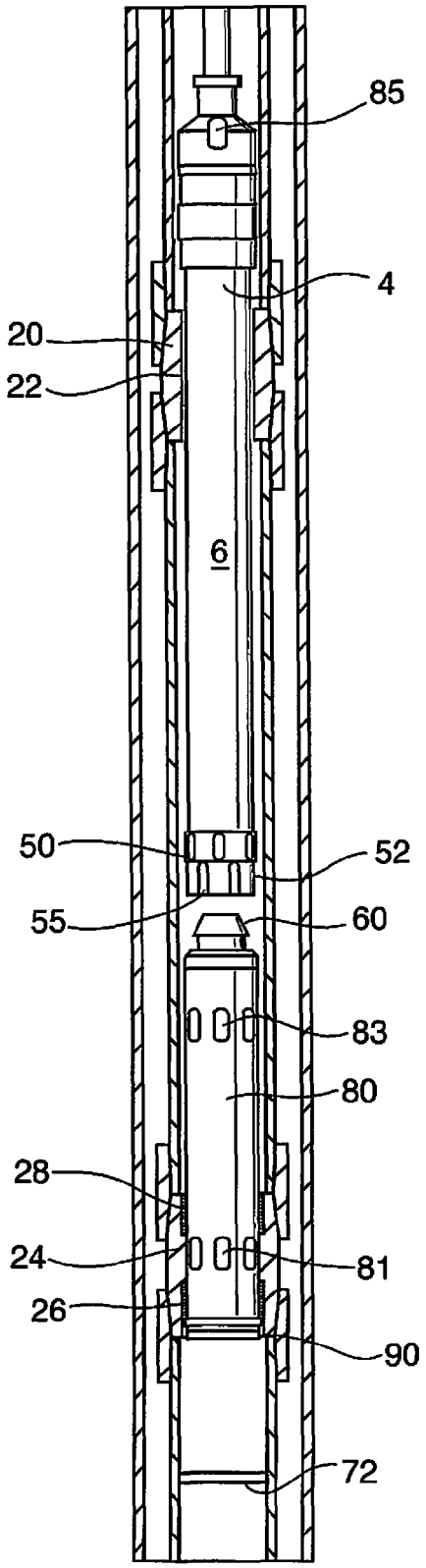
FIG. 2C is a subsequent cross-sectional view of the downhole tubing assembly of FIG. 2B, wherein the pump assembly has been further raised.

Upon further raising of pump assembly 4, due to protruding lip 90 on ported sleeve 80 contacting lower edge of seal sub 24 and being thereby prevented from further upward movement, flexible fingers 52 and hook edges 55 thereon encircling bulbous spherical knob 60 on ported sleeve 80 are caused to resiliently spread or flex, thereby causing latch member 50 to be decoupled from engagement with ported sleeve 80, as shown in FIG. 2C, thereby allowing pump assembly 4 to be further raised and removed from production well 12. Advantageously first port means 81 remains positioned between lower seal means 26 and upper seal means 28 of seal sub 24, as shown in FIG. 2D, thereby preventing migration of any pressurized fluid and/or gases from travelling up production tubing 30 to surface when pump assembly 4 is absent from the well 12.

Figure 2D:
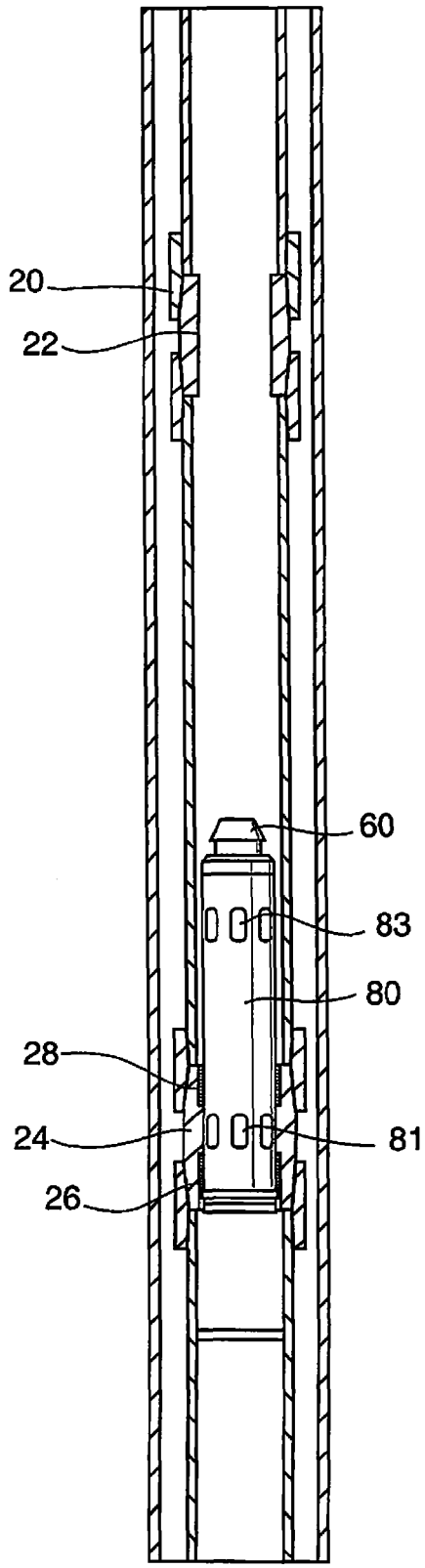
FIG. 2D is a subsequent cross-sectional view of the downhole tubing assembly of FIGS. 2A-2C, wherein the pump assembly has been removed from the well.

Conversely, when lowering a new or serviced pump 6 back into well 12 and production tubing 30, the reverse series of steps is followed, namely the steps illustrated in the sequence of FIGS. 2D-2A, resulting in pump assembly 4 being positioned in the operative pumping position as shown in FIG. 2A.

Specifically, pump assembly 4 is lowered in production tubing 30, so that seating surface on hold-down member 16 sealingly re-engages and contacts circumferential seal 22 on seating nipple 20. Latch member 50 is forced downwardly on ported sleeve 80, moving ported sleeve 80 downwardly so that first port means 81 is positioned below lower seal means 26 of seal sub 24. Movement of the ported sleeve 80 is arrested once the ported sleeve 80 contacts "stop" member 72, whereupon resilient flexing of flexible fingers 52 and hook edges 55 on latch member 50 permits fingers 52 and hook edges 55 to then surround bulbous knob 60 and thereby recouple latch member 50 to ported sleeve 80.

By ported sleeve 80 being shifted downwards so that first port means 81 is positioned below lower seal means 26, production fluid (e.g. oil 3) is then permitted access to pump inlet/intake 8 and may then be pumped to surface.

While second port means 83 is at least one aperture in the ported sleeve 80 sidewall, or preferably at least two apertures, or more preferably a plurality of apertures, in the sidewall of ported sleeve 80, alternatively, the second port means may comprise an aperture in the top of ported sleeve 80. When pump 6 is activated in such an embodiment, production fluid (e.g. oil 3) is drawn from the well 12 through the first port means 81 and into the ported sleeve 80, through the interior of the ported sleeve 80, and out of the ported sleeve 80 through second port means 83 and directly into pump 6.

Figure 5:
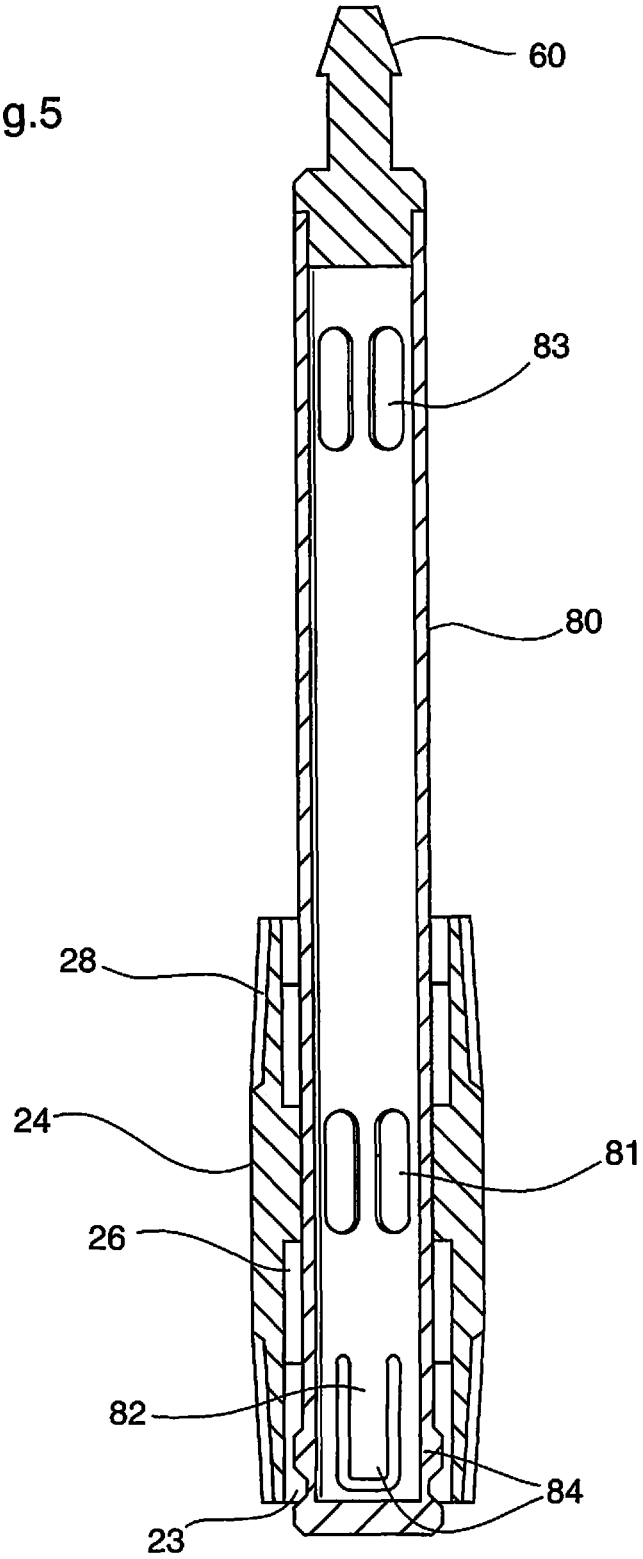
FIG. 5 is a cross-sectional view of an alternative embodiment of the downhole ported sleeve of the present invention in a downhole sealing position.

Referring to FIG. 5, an alternative embodiment of ported sleeve 80 is shown, and its manner of operation. Similar to the above embodiments, ported sleeve 80 comprises first port means 81, second port means 83, and a protruding bulbous knob portion 60. The ported sleeve 80 is shown positioned within seal sub 24 with the first port means 81 positioned between lower seal means 26 and upper seal means 28, such seal means 26 and 28 respectively in a preferred embodiment comprising elastomeric sealing rings of vulcanized rubber, as shown in FIG. 5, but other similar seal means, 26, 28 of similar materials may likewise be used as will occur to a person of skill in the art. The ported sleeve 80 comprises collet fingers 82, which are machined into the sidewall of ported sleeve 80. Preferably the collet fingers 82 are positioned below lower seal means 26 to provide additional stabilization between ported sleeve 80 and seal sub 24 when ported sleeve 80 is in a sealing position, that is, when first port means 81 is positioned between the lower seal means 26 and upper seal means 28. The collet fingers 82 comprise a bulbous outwardly protruding tab 84 which is complementary to and sits within a mating annular profile 23 within seal sub 24 when ported sleeve 80 is positioned with first port means 81 between lower seal means 26 and upper seal means 28. Preferably, the ported sleeve 80 compromises at least two vibrating-reed like collet fingers 82. However, the size, number, position, and arrangement of collet fingers 82 would be in the knowledge of a person of skill in the art.

When ported sleeve 80 is shifted downwards to a producing position in which first port means 81 is below seal sub 24, collet fingers 82 are temporarily retracted due to the internal diameter of annular profile 23. As the ported sleeve 80 continues to be shifted downwards and collet fingers 82 clear annular profile 23, the collet fingers 82 return to their protracted position.

When ported sleeve 80 is shifted upwards, that is, to a sealing position, the outwardly protrubing tab 84 of collet fingers 82 are temporarily retracted due to the internal diameter of mating annular profile 23 while being brought into seal sub 24, but assume their protracted position within mating annular profile 23.

Figure 6:
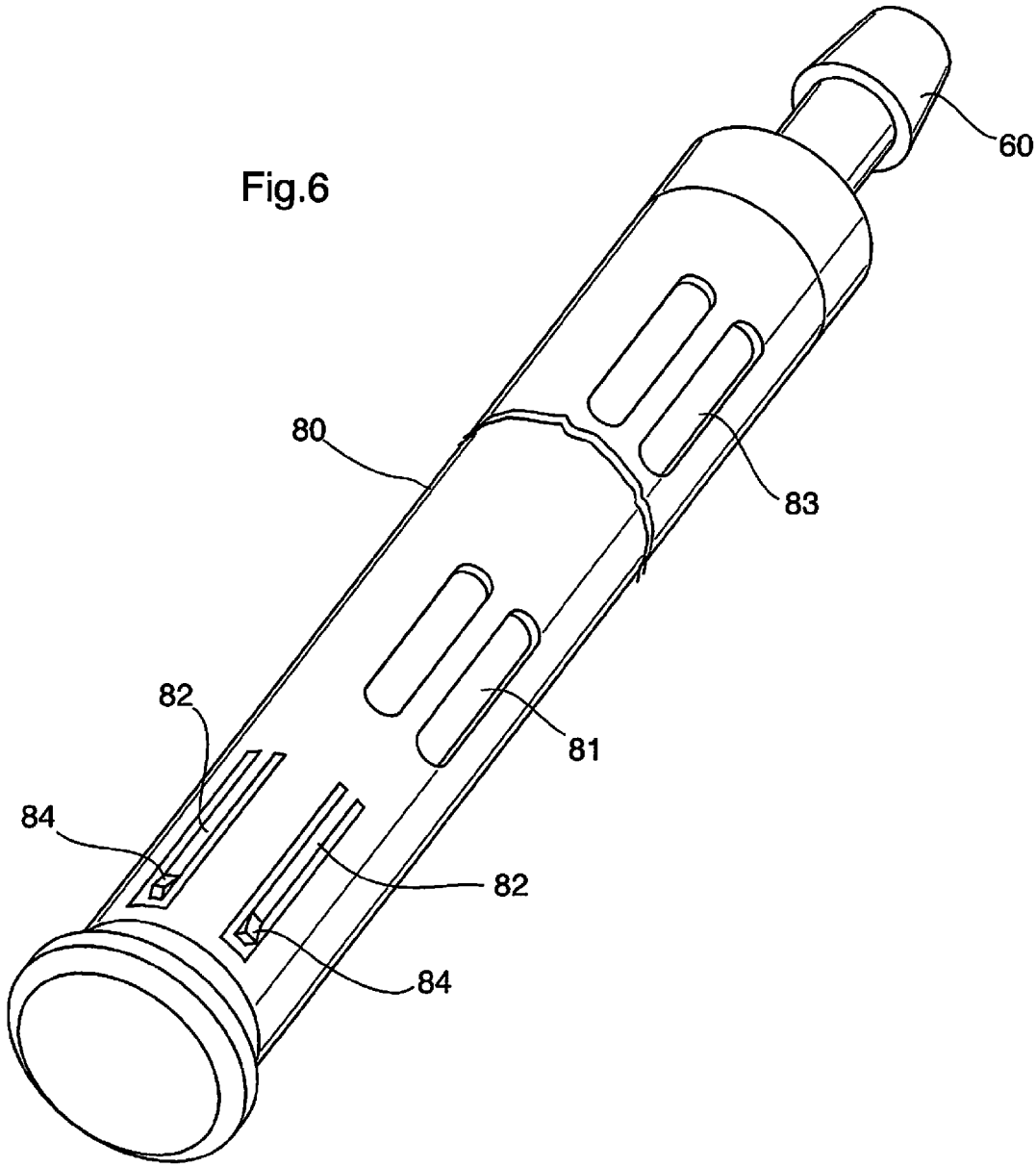
FIG. 6 is a perspective view of the alternative embodiment of the downhole ported sleeve only, which is shown in FIG. 5.

Referring to FIG. 6, FIG. 6 is a perspective view of the alternative embodiment of the downhole ported sleeve 80 of the present invention shown in FIG. 5, showing the collet fingers 82, and the outwardly protruding tab 84 thereon, in greater detail. As explained above with regard to FIG. 5, when ported sleeve 80 is shifted downwards to a producing position in which first port means 81 is below seal sub 24, collet fingers 82 are temporarily retracted due to the internal diameter of annular profile 23. As the ported sleeve 80 continues to be shifted downwards and collet fingers 82 clear annular profile 23, the collet fingers 82 return to their protracted position.

This invention is not limited to the particular preferred embodiment of the latch member 50 discussed above, and other similar latch mechanisms will now be apparent and/or known to persons of skill in the art, and are included as a means of operating this invention. The invention is not to be considered to be limited to the latch member 50 of the preferred embodiment shown in FIGS. 2A-2D and FIGS. 4A-40, 5, & 6 but all manner of releasably coupleable latch means are contemplated within the scope of this invention.

The foregoing description of the disclosed embodiments is provided to enable any person skilled in the art to make or use the present invention. The scope of the claims should not be limited by the preferred embodiments set forth in the examples, but should be given the broadest interpretation consistent with the description as a whole. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties, as well as solids and semi-solids.

For a complete definition of the invention and its intended scope, reference is to be made to the summary of the invention and the appended claims read together with and considered with the disclosure and drawings herein.

We claim:

1. A downhole apparatus for preventing at least one of fluids and gases within a hydrocarbon formation from having communication with surface, the downhole apparatus comprising:

production tubing comprising a first circumferential seal means;

a pump assembly having a lower end and comprising:

a pump; and a seating surface constructed and arranged to sealingly engage said first circumferential seal means;

a seal sub positionable proximate said lower end of said pump assembly and comprising a lower circumferential seal means and an upper circumferential seal means longitudinally spaced-apart from each other within said seal sub;

a ported sleeve longitudinally spaced apart from said seating surface on the pump assembly and releasably coupled to said lower end of said pump assembly, constructed and arranged to sealingly engage said upper circumferential seal means and said lower circumferential seal means and for linear movement within said seal sub from a producing position to a sealing position, the ported sleeve comprising:

first port means proximate a lower end of said sleeve; and second port means proximate an upper end of the sleeve; and a releasable latch means on said lower end of said pump assembly, constructed and arranged for releasably coupling said ported sleeve;

wherein said ported sleeve is moveable from said producing position in which said first port means is positioned below said lower circumferential seal means and said second port means is positioned above said upper circumferential seal means to said sealing position in which said first port means is positioned between said lower circumferential seal means and said upper circumferential seal means and said releasable latch means de-couples from said ported sleeve when said pump assembly is raised from a downhole operative position.

2. The downhole pump apparatus according to claim 1, wherein said first port means comprises at least two apertures in the sidewall of said ported sleeve.

3. The downhole pump apparatus according to claim 2, wherein said at least two apertures comprise a plurality of machined slots.

4. The downhole apparatus according to claim 1, wherein said first port means comprises a plurality of apertures, arranged circumferentially, within the sidewall of said ported sleeve.

5. The downhole pump apparatus according to claim 1, wherein said second port means comprises at least two apertures in the sidewall of said ported sleeve.

6. The downhole pump apparatus according to claim 5, wherein said at least two apertures comprise a plurality of machined slots.

7. The downhole pump apparatus according to any one of claim 1, 2 or 3, wherein said second port means comprises a plurality of apertures, arranged circumferentially, within the sidewall of said ported sleeve.

8. The downhole pump apparatus according to any one of claim 1, 2 or 3, wherein said second port means comprises a port in the top of said ported sleeve.

9. A method for preventing at least one of downhole fluids and gasses in a hydrocarbon formation from reaching surface, the method comprising the steps of:

(a) providing first circumferential seal means along an elongate tubing means;

(b) providing a downhole pump assembly, having at an upper end thereof a seating surface;

(c) providing a seal sub proximate a lower end of said elongate tubing means and comprising a lower seal means and an upper seal means;

(d) providing a ported sleeve, releasably coupleable to a lower end of said downhole pump assembly, and dimensioned to sealingly engage said lower seal means and said upper seal means, the ported sleeve comprising a first port means proximate a lower end of the ported sleeve and positionable below said lower seal means and a second port means proximate an upper end of the ported sleeve and positionable above the upper seal means;

(e) providing latch means, situated on a lower end of said downhole pump assembly opposite said upper end thereof, adapted for releasably coupling said ported sleeve to said lower end of said downhole pump assembly;

(f) lowering said pump assembly into a downhole operative position within a well so as to permit said seating surface thereon to sealingly engage said first circumferential seal means and to position the ported sleeve with said first port means positioned below said lower seal means and said second port means positioned above said upper seal means;

(g) raising said downhole pump assembly thereby ceasing sealing engagement between said first circumferential seal means and said seating surface, and simultaneously causing said ported sleeve to be raised so that the first port means is positioned between said lower seal means and said upper seal means so as to prevent communication from a downhole side of said ported sleeve to an uphole side of said ported sleeve; and (h) uncoupling said latch means from said ported sleeve so as to permit said ported sleeve to thereby remain downhole when said downhole pump assembly is further raised and removed from said well.

10. The method according to claim 9, further comprising after step (h), the steps of:

(i) lowering said downhole pump assembly within said well so as to permit said seating surface thereon to sealingly re-engage said first circumferential seal means and simultaneously causing said latch assembly thereon to engage said ported sleeve; and (j) forcing said ported sleeve downwardly so that the first port means is positioned below said lower seal means and said second port means is positioned above said upper seal means.

* * * * *